US011383361B2

(12) United States Patent
Lin

(10) Patent No.: US 11,383,361 B2
(45) Date of Patent: Jul. 12, 2022

(54) ELECTRO-MECHANICAL TORQUE WRENCH

(71) Applicant: TORQUE-TECH PRECISION CO., LTD., Taichung (TW)

(72) Inventor: Tien-Lung Lin, Taichung (TW)

(73) Assignee: TORQUE-TECH PRECISION CO., LTD., Taichung (TW)

( * ) Notice: Subject to any disclaimer, the term of this patent is extended or adjusted under 35 U.S.C. 154(b) by 288 days.

(21) Appl. No.: 16/885,078

(22) Filed: May 27, 2020

(65) Prior Publication Data

US 2021/0260736 A1 Aug. 26, 2021

(30) Foreign Application Priority Data

Feb. 25, 2020 (TW) ..... 109106029

(51) Int. Cl.
*B25B 23/142* (2006.01)

(52) U.S. Cl.
CPC ..... *B25B 23/1425* (2013.01)

(58) Field of Classification Search
CPC ..... B25B 23/1427; B25B 23/1425; B25B 23/1422; B25B 21/00; B25B 23/147; B25B 13/462; B25B 13/465; B25B 21/004
USPC ..... 81/478, 467, 60
See application file for complete search history.

(56) References Cited

U.S. PATENT DOCUMENTS

2014/0352503 A1* 12/2014 Hsieh ..... B25B 13/462 81/478
2019/0061123 A1* 2/2019 Yamaguchi ..... B25B 23/1425
2019/0275647 A1* 9/2019 Silha ..... B25B 21/004

* cited by examiner

*Primary Examiner* — Andrew M Tecco
*Assistant Examiner* — Jacob A Smith
(74) *Attorney, Agent, or Firm* — Pai Patent & Trademark Law Firm; Chao-Chang David Pai

(57) ABSTRACT

An electro-mechanical torque wrench has a main body. A trip mechanism is provided in the main body. The trip mechanism includes a long rod and a short rod arranged side-by-side. A release member is connected between the long rod and the short rod. When in operation, the long rod and the short rod are subject to torque to cause flex. When the torque reaches a preset torque value, the release member is released to generate a mechanical sound and vibration to prompt a user to stop operation. The long rod is provided with at least one strain sensor, and the strain sensor is connected with a display module for sensing the amount of deformation of the long rod and transmitting sensing information to the display module, so that the display module outputs a corresponding torque value in a digital display manner.

10 Claims, 6 Drawing Sheets

ELECTRO-MECHANICAL TORQUE WRENCH

FIELD OF THE INVENTION

The present invention relates to a torque wrench, and more particularly to an electro-mechanical torque wrench that has a mechanical trip structure and a function to display torque values digitally.

BACKGROUND OF THE INVENTION

With advantages of durability and high accuracy, mechanical torque wrenches are widely used by the public. In general, a mechanical torque wrench mainly has a main body. One end of the main body is provided with a working head, and the other end of the main body is provided with a grip. A trip mechanism is provided in the main body and connected to the working head. Therefore, when a user operates the mechanical torque wrench, the trip mechanism bears the torque transmitted by the working head. When the applied torque is greater than the torque value set by the user, the trip mechanism is released to produce a sound and vibration to prompt the user to stop operation. Furthermore, the mechanical torque wrench is provided with a torque adjustment mechanism. The torque adjustment mechanism includes a spring, which allows the user to adjust the torque value by adjusting the compression of the spring.

However, the conventional mechanical torque wrench has the following disadvantages. First, when the user applies force to the grip, the mechanical torque wrench cannot simultaneously display the present torque value, that is, the information of torque values from the initial applied force to the actuation of the trip mechanism cannot be obtained by the user. Second, the user needs to reset the preset torque value of the conventional torque adjustment mechanism to zero after each operation to avoid elastic fatigue caused by the continuous compression of the spring. However, this mechanism will cause inconvenience to users. Third, the torque adjustment mechanism is generally disposed at one side of the main body, which makes the user likely touch the torque adjustment mechanism by accident during operation. Fourth, the conventional trip mechanism has the spring against a roller, and the roller is against an inclined surface of the working head. When the applied torque is greater than the elastic force of the spring, the roller will be disengaged. However, this design is bulky, so the conventional mechanical torque wrench has insufficient space for accommodating a sensor.

SUMMARY OF THE INVENTION

The primary object of the present invention is to provide an electro-mechanical torque wrench that has a mechanical trip structure and a function to display torque values digitally. The electro-mechanical torque wrench is convenient for use and easy to read the torque values. Another object of the present invention is to provide an electro-mechanical torque wrench that allows a user to adjust a pre-set torque value by releasing an anti-misoperation unit, so as to prevent misoperation from touching by accident.

In order to achieve the primary object, the present invention provides an electro-mechanical torque wrench, comprising a main body. A trip mechanism is provided in the main body. The trip mechanism includes a long rod and a short rod arranged side-by-side. One end of the short rod is provided with a bearing portion. A rotatable releasing member is pivotally connected to a middle section of the long rod. One side of the releasing member, close to the short rod, is provided with a pressing portion corresponding to the bearing portion. Another side of the releasing member, away from the short rod, is provided with an extension portion. An elastic member is connected between the extension portion and the long rod, so that the releasing member is biased by elastic force of the elastic member for enabling the pressing portion to press against the bearing portion. Thereby, when the user intends to secure a workpiece and apply force to the grip, the long rod and the short rod of the electro-mechanical torque wrench are subject to torque to cause flex. When the torque reaches a preset torque value, the bearing portion is disengaged from the pressing portion to produce a mechanical sound and slight vibration to prompt the user to stop operation. A peripheral side of the long rod is provided with at least one strain sensor, and the strain sensor is electrically connected with a display module for sensing the amount of deformation of the long rod and transmitting the sensing information to the display module, so that the display module outputs a corresponding torque value in a digital display manner.

In order to achieve another primary object, the present invention provides an electro-mechanical torque wrench. The long rod is formed with a screw hole, and a screw rod is disposed in the screw hole. One end of the screw rod extends out of the main body and is provided with a knob. The knob is configured to drive rotation of the screw rod, so that the rotating screw rod enables the position of the long rod to be adjustable. The electro-mechanical torque wrench further comprises an anti-misoperation unit. The anti-misoperation unit includes a limiting member connected to the tubular body and an operating member disposed on the screw rod. The operating member enables to axially slide only along a displacement direction of the screw rod between a locked position and an unlocked position. When in the locked position, the operating member is confined by the limiting member, so that the screw rod cannot be rotated. When in the unlocked position, the operating member is disengaged from the limiting member, so that the screw rod is rotatable to adjust the preset torque. Thereby, the operating member of the anti-misoperation unit must be switched to the unlocked position by the user to make the knob rotatable for adjusting the preset torque, and the misoperation by accident can be avoided.

DETAILED DESCRIPTION OF THE PREFERRED EMBODIMENTS

Embodiments of the present invention will now be described, by way of example only, with reference to the accompanying drawings.

Figure 1:
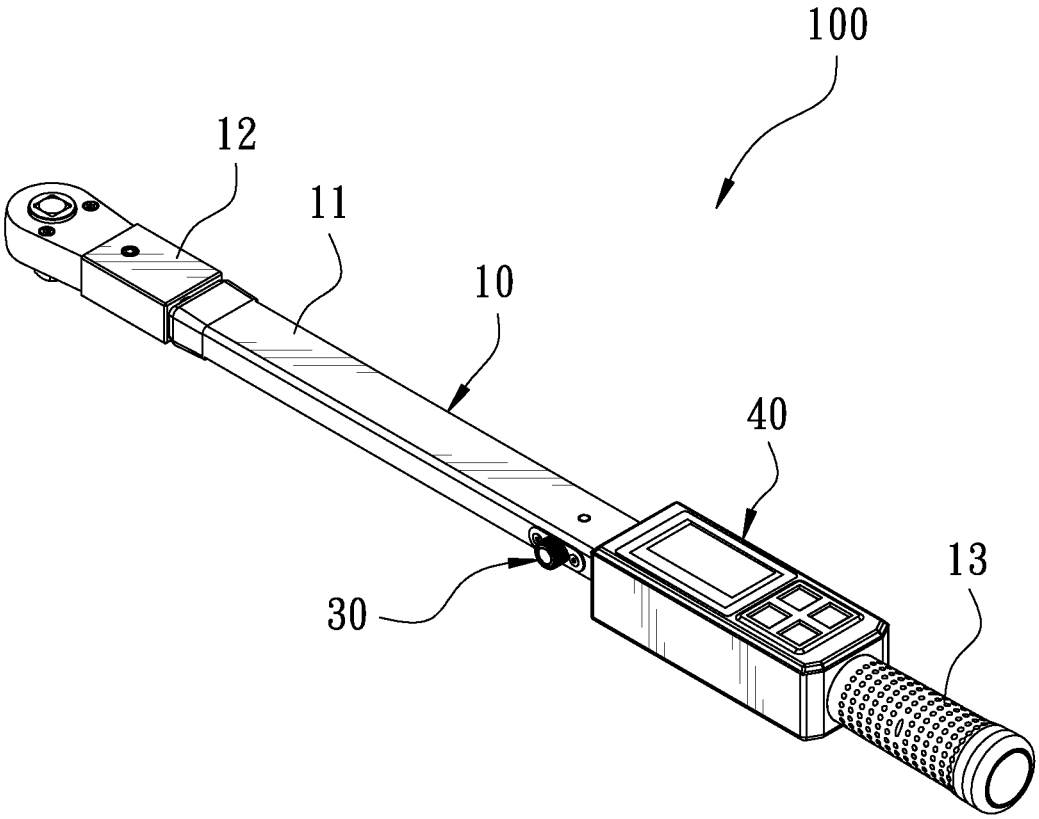
FIG. 1 is a perspective view in accordance with a preferred embodiment of the present invention.
Figure 2:
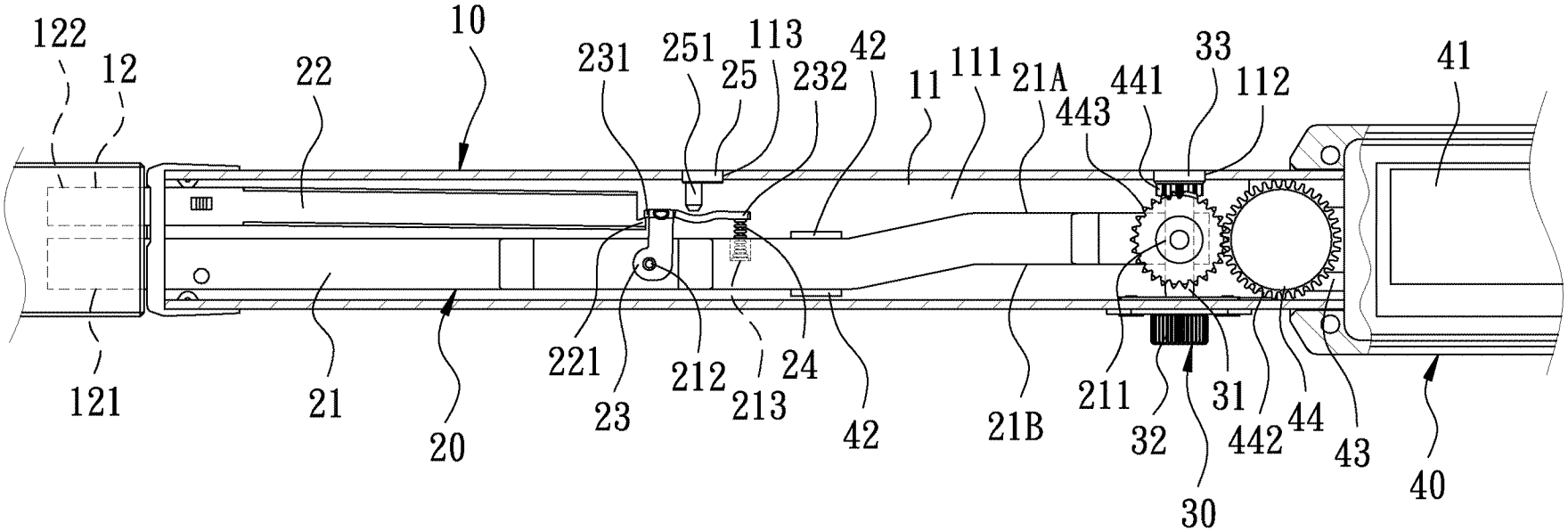
FIG. 2 is a cross-sectional view in accordance with the preferred embodiment of the present invention.

FIG. 1 is a perspective view in accordance with a preferred embodiment of the present invention. FIG. 2 is a cross-sectional view in accordance with the preferred embodiment of the present invention. The present invention discloses an electro-mechanical torque wrench 100. The electro-mechanical torque wrench 100 includes a main body 10 having a hollow tubular body 11. One end of the tubular body 11 is provided with a working head 12, and the other end of the tubular body 11 is provided with a grip 13. The tubular body 11 has a chamber 111 therein. A trip mechanism 20 is accommodated in the chamber 111. An outside of the tubular body 11 close to the grip 13 is formed with at least one shaft hole 112 that is in communication with the chamber 111. A torque adjustment mechanism 30 is insertedly disposed in the shaft hole 112. A digital display unit 40 is disposed on the outside of the tubular body 11 close to the grip 13. In this embodiment, the digital display unit 40 is disposed between the shaft hole 112 and the grip 13.

Referring to FIG. 2, the trip mechanism 20 includes a long rod 21 and a short rod 22 arranged side-by-side in the chamber 111. One end of the long rod 21 is inserted and disposed in a first connecting hole 121 of the working head 12, and the other end of the long rod 21 extends along an axial direction of the tubular body 11 to a position adjacent to the shaft hole 112 and is formed with a screw hole 211 corresponding to the shaft hole 112. One end of the short rod 22 is inserted and connected to a second connecting hole 122 of the working head 12, and the other end of the short rod 22 extends along the axial direction of the tubular body 11 to a position near a middle section of the long rod 21. The other end of the short rod 22 is provided with a bearing portion 221. The trip mechanism 20 further includes a releasing member 23 located at the middle section of the long rod 21. One end of the releasing member 23 is pivotally disposed at the long rod 21 through a pivot pin 212 and rotatable relative to the long rod 21, and the other end of the releasing member 23 extends toward the short rod 22. A pressing portion 231 is disposed at the other end of the releasing member 23, and the pressing portion 231 faces toward the short rod 22 and corresponds to the bearing portion 221. The pressing portion 231 of the releasing member 23 is close to the short rod 22. An extension portion 232 opposite to the pressing portion 231 is disposed at the other end of the releasing member 23, and the extension portion 232 of the releasing member 23 is away from the short rod 22. The trip mechanism 20 further includes an elastic member 24, such as a compression spring. One end of the elastic member 24 is accommodated in a counterbore 213 disposed at the long rod 21, and the other end of the elastic member 24 is connected to the extension portion 232, so that the releasing member 23 is biased by elastic force of the elastic member 24 for enabling the pressing portion 231 to continuously press against the bearing portion 221. In addition, the tubular body 11 is formed with a fixing hole 113 communicating with the chamber 111 and corresponding to the releasing member 23. The trip mechanism 20 has an abutment member 25 disposed in the fixing hole 113 and including an abutment rod 251 extending toward the extension portion 232. Thereby, when the user intends to secure a workpiece and apply force to the grip 13, the long rod 21 and the short rod 22 of the electro-mechanical torque wrench 100 are subject to torque to cause flex. With the increase of applied force, the releasing member 23 gradually approaches the abutment member 25. When the torque reaches a preset torque value, the extension portion 232 of the releasing member 23 is blocked by the abutment member 25 and pivotally rotates about the pivoting pin 212 in a clockwise direction, so that the bearing portion 221 is disengaged from the pressing portion 231 to produce a mechanical sound and slight vibration to prompt the user to stop operation. Since the long rod 21 and the short rod 22 of the trip mechanism 20 are non-spring mechanisms, the elastic fatigue will not occur in the electro-mechanical torque wrench of this invention. After use, there is no need to reset the preset torque value of the torque adjustment mechanism 30 to zero, thereby greatly improving convenience of use.

Figure 3:
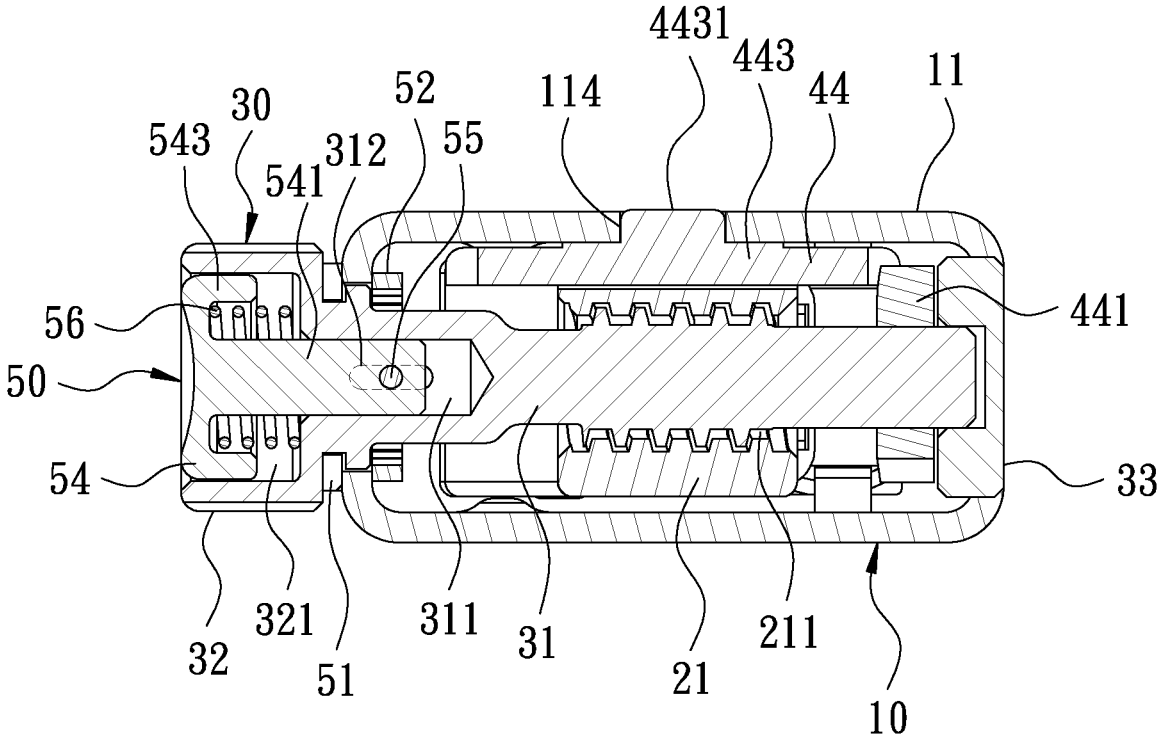
FIG. 3 is a cross-sectional view showing the torque adjustment mechanism according to the preferred embodiment of the present invention.

FIG. 3 is a cross-sectional view showing the torque adjustment mechanism according to the preferred embodiment of the present invention. The torque adjustment mechanism 30 has a screw rod 31 passing through the shaft hole 112 and the screw hole 211. One end of the screw rod 31 extends out of the shaft hole 112 and is provided with a knob 32. Preferably, two shaft holes 112 are respectively disposed at two sides of the tubular body 11, and the shaft holes correspond to each other. The other end of the screw rod 31 is provided with an end cap 33. The end cap 33 is fixed to the shaft hole 112 at the other side of the tubular body 11. When the screw rod 31 is driven for rotation by the knob 32, the long rod 21 is movable along an insertion direction of the screw rod 31 for the reason that the screw rod 31 is engaged with the screw hole 31 of the long rod 21. Accordingly, the preset torque value of the electro-mechanical torque wrench 100 can be adjustable.

Figure 4:
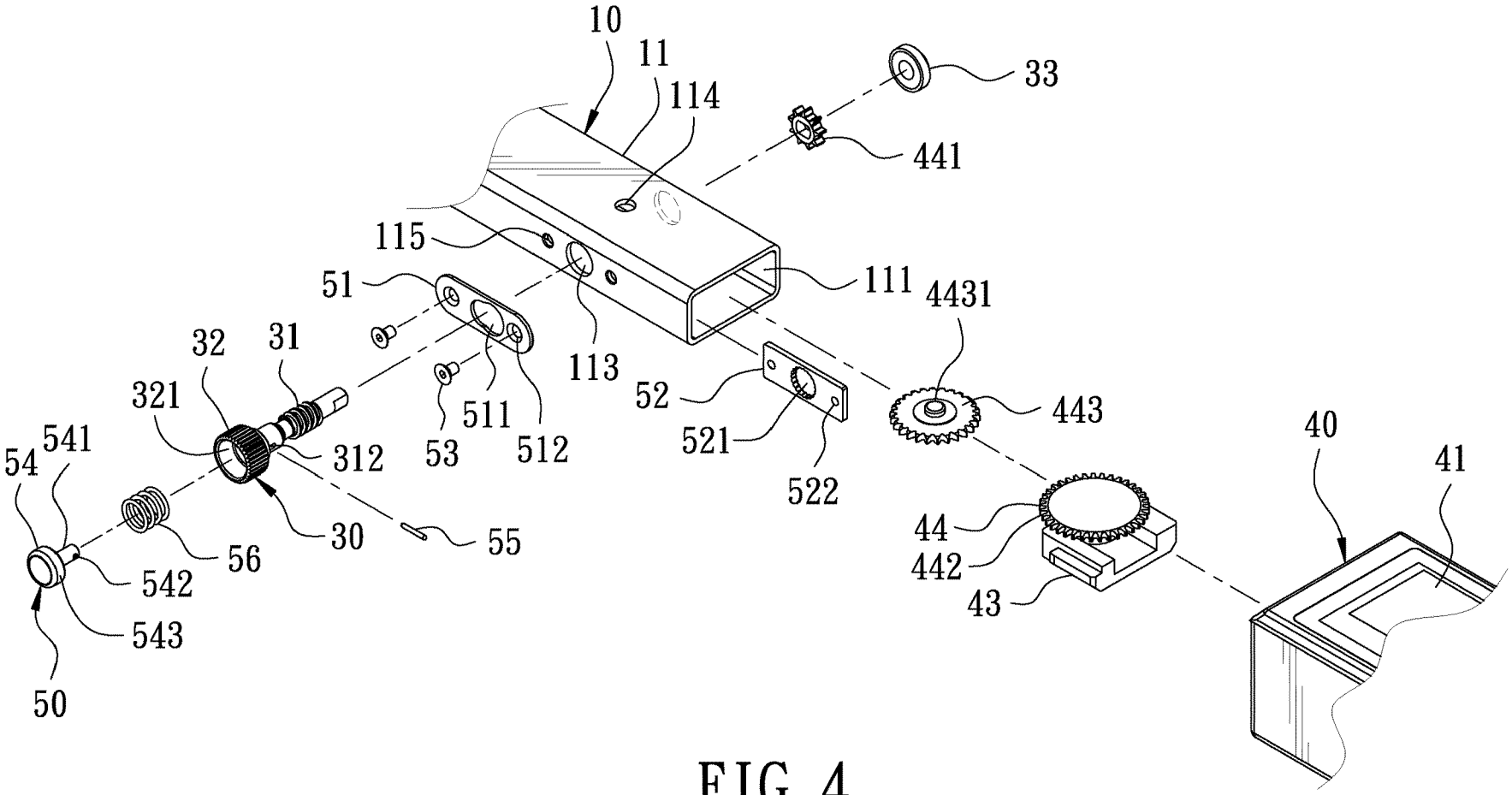
FIG. 4 is an exploded view showing the torque adjustment mechanism according to the preferred embodiment of the present invention.

FIG. 4 is an exploded view showing the torque adjustment mechanism according to the preferred embodiment of the present invention. Please also refer to FIG. 2. The digital display unit 40 has a display module 41 disposed on the outside of the tubular body 10. At least one strain sensor 42 is electrically connected to the display module 41. As shown in FIG. 2, the strain sensor 42 is arranged on a peripheral side of the long rod 21 for sensing the amount of deformation of the long rod 21 and transmitting the sensing information to the display module 41 so that the display module 41 outputs a corresponding torque value in a digital display manner. The two ends of the long rod 21 are connected to the torque adjustment mechanism 30 and the working head 12, respectively. The torque adjustment of the torque adjustment mechanism 30 will result in displacement of the long rod 21. When the work head 12 is used to secure the workpiece, the force applied by the user will cause the long rod 21 to flex. Therefore, based on the structure of the long rod 21 and the short rod 22, the strain sensor 42 has to attach to the peripheral side of the long rod 21 for making the digital display unit 40 truly display its torque value. In addition, in case of the strain sensor 42 attached to the short rod 22, when a predetermined torque is reached, the short rod 22 will be released and collide with an inner edge of the tubular body 11. The vibration caused by the collision likely leads to damage of the strain sensor 42. In this embodiment, the digital display unit 40 has a plurality of strain sensors 42. The strain sensors 42 are symmetrically disposed on the peripheral side of the long rod 21. Preferably, the long rod 21 has an upper face 21A facing the short rod 22 and a lower face 21B opposite the upper face 21A. A first plural of the strain sensors 42 are disposed on the upper face 21A and a second plural of the strain sensors 42 are disposed on the lower face 21B. Owing to the applied force of the grip 13 from the user enables the upper face 21A and the lower face 21B to sustain more stress. When the long rod 21 is under force, the upper face 21A and the lower face 21B possess larger variation comparing to other faces of the long rod 21. Therefore, the strain sensors 42 attached to the above-mentioned surfaces may obtain more accurate torque sensing values. A position sensor 43 close to the torque adjustment mechanism 30 is electrically connected to the display module 41. The position sensor 43 and the screw rod 31 are connected through a driving mechanism 44. In this embodiment, the driving mechanism 44 includes a first gear 441 connected to the screw rod 31, a second gear 442 connected to the position sensor 43, and a third gear 443 pivoted to the tubular body 11 and engaged between the first gear 441 and the second gear 442. The first gear 441 is sleeved onto the screw rod 31. The tubular body 11 is formed with a pivot hole 114. The third gear 443 is provided with a rotating shaft 4431. The rotating shaft 4431 is inserted in the pivot hole 114 to make the third gear 443 pivotally disposed at the tubular body 11. Thus, the amount of variation of the screw rod 31 can be sensed and transmitted to the display module 41 via the position sensor 43, so that the display module 41 outputs the corresponding preset torque value. Thereby, when the user operates the electro-mechanical torque wrench 100, the torque value can be displayed in a digital display manner through the digital display unit 40, which facilitates the user's interpretation.

Figure 5:
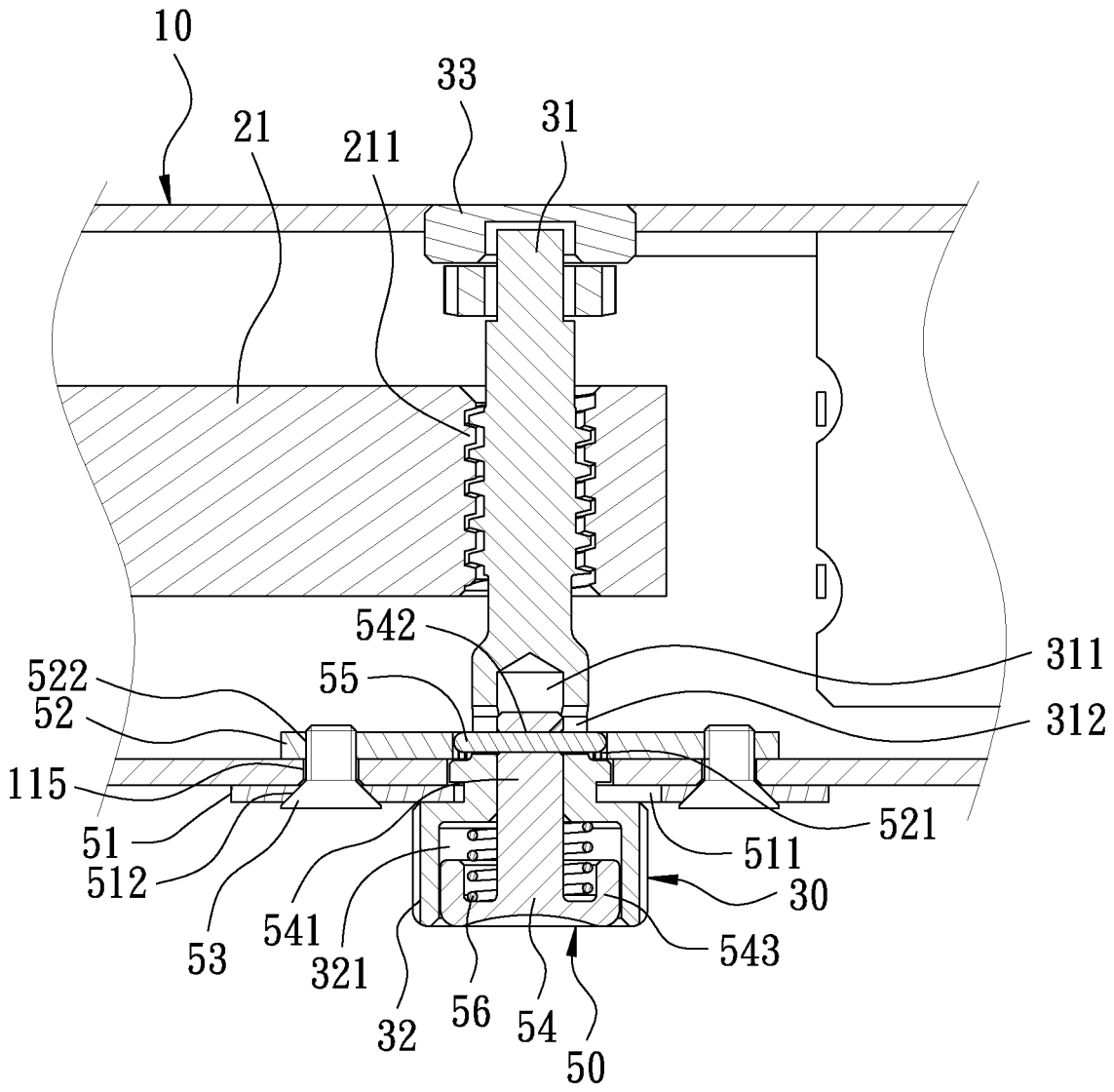
FIG. 5 is another cross-sectional view showing the torque adjustment mechanism according to the preferred embodiment of the present invention.
Figure 6:
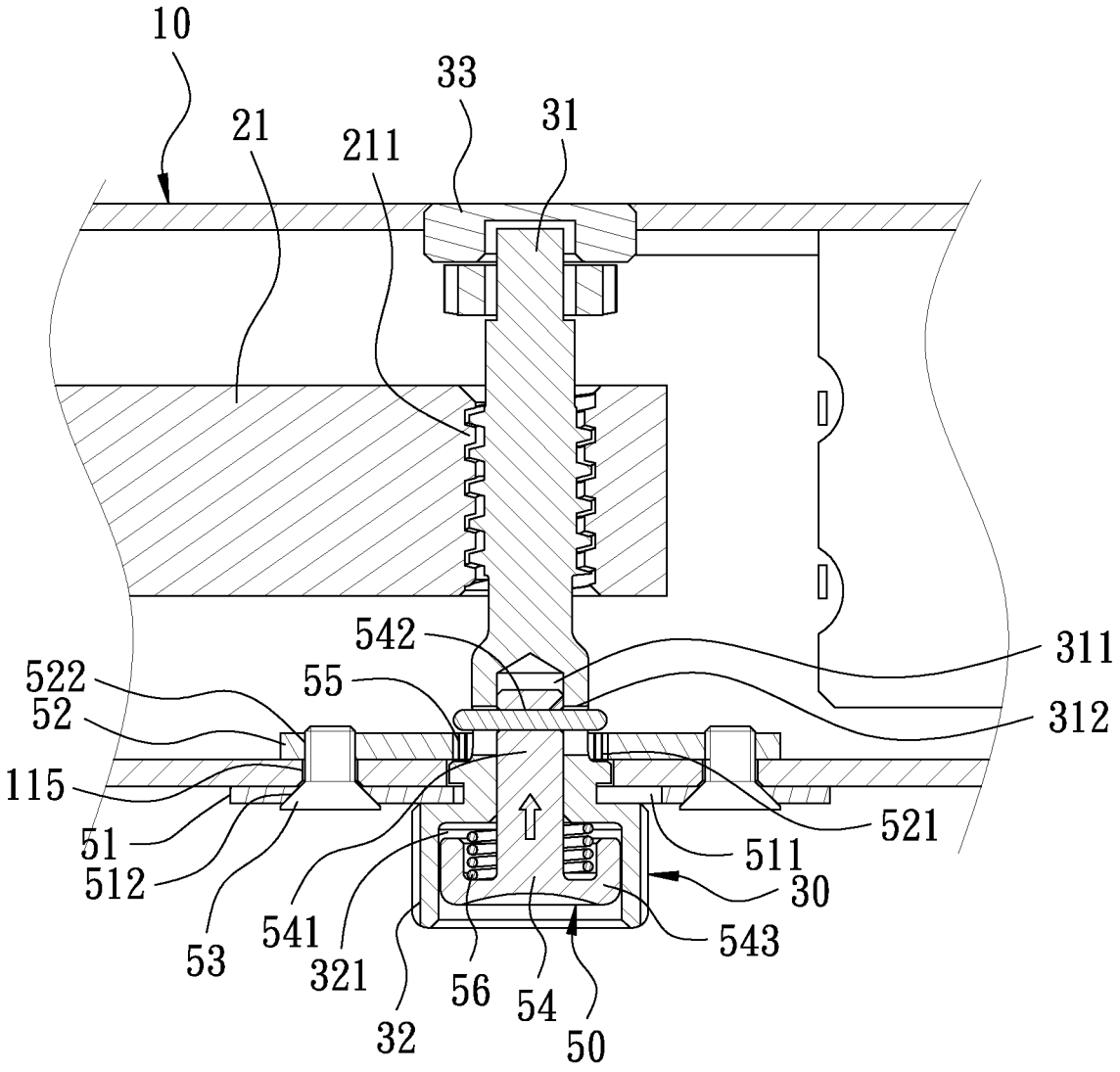
FIG. 6 is a schematic view showing the operation of the preferred embodiment of the present invention.

FIG. 5 is another cross-sectional view showing the torque adjustment mechanism according to the preferred embodiment of the present invention. FIG. 6 is a schematic view showing the operation of the preferred embodiment of the present invention. The tubular body 11 is formed with a plurality of positioning holes 115 close to the shaft hole 112. The electro-mechanical torque wrench 100 further includes an anti-misoperation unit 50. The anti-misoperation unit 50 includes a fixing member 51 disposed on the outside of the tubular body 11 and a limiting member 52 disposed in the chamber 111. The fixing member 51 has an enlarged hole 511 corresponding to the shaft hole 112 and a plurality of perforations 512 corresponding to the positioning holes 115. The limiting member 52 has a polygonal hole 521 corresponding to the shaft hole 112 and a plurality of locking holes 522 corresponding to the positioning holes 115. The anti-misoperation unit 50 further includes a plurality of locking members 53. Each of the locking members 53 is inserted in each of the corresponding perforations 512, the positioning holes 115 and the locking holes 522, respectively, so as to fix the fixing member 51 and the limiting member 52 to the tubular body 11. In addition, an outer side of the knob 32 is recessed to form an accommodating trough 321. A bottom of the accommodating trough 321 is further recessed to form a blind hole 311 extending into the screw rod 31. An outer periphery of the screw rod 31 is formed with a slot 312 communicating with the blind hole 311. The anti-misoperation unit 50 further includes an operating member 54 disposed on the tubular body 11. The operating member 54 is accommodated in the accommodating trough 321 and has a shaft portion 541 inserted in the blind hole 311. The shaft portion 541 is formed with a through hole 542 corresponding to the slot 312. The through hole 542 is provided with a limiting pin 55. An end of the limit pin 55 extends out of the through hole 542 and is located in the slot 312, so that the operating member 54 enables to axially slide only along a displacement direction of the screw rod 31 between a locked position and an unlocked position. When the operating member 54 is in the locked position, as shown in FIG. 5, the limiting pin 55 is engaged and constrained in the polygonal hole 521 of the limiting member 52, so that the screw rod 31 cannot be rotated. When the operating member 54 is in the unlocked position, as shown in FIG. 6, the limiting pin 55 is disengaged from the polygonal hole 521 of the limiting member 52, so that the screw rod 31 is rotatable to adjust the torque. In addition, one end of the shaft portion 541, located in the accommodating trough 321, is enlarged to form a head 543. The anti-misoperation unit 50 further includes a spring 56 sleeved onto the shaft portion 541. Two ends of the spring 56 abut against the head 543 and an inner wall surface of and the accommodation trough 321, respectively, so that the operating member 54 is biased by elastic force of the spring 56 and has a tendency from the unlocked state to the locked state. Thereby, the operating member 54 of the anti-misoperation unit 50 must be switched to the unlocked position by pressing the head 543 to make the knob 32 rotatable for adjusting the preset torque value, and the misoperation by accident can be effectively avoided.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electro-mechanical torque wrench, comprising:

a main body, having a hollow tubular body, one end of the tubular body being provided with a working head, another end of the tubular body being provided with a grip, wherein the tubular body has a chamber therein, an outside of the tubular body is formed with a fixing hole and at least one shaft hole that are in communication with the chamber;

a trip mechanism, including a long rod and a short rod arranged side-by-side in the chamber, wherein one end of the long rod is connected to the working head, another end of the long rod is provided with a screw hole corresponding to the shaft hole, one end of the short rod is connected to the working head, another end of the short rod is provided with a bearing portion, a rotatable releasing member is pivotally connected to a middle section of the long rod, one side of the releasing member, close to the short rod, is provided with a pressing portion corresponding to the bearing portion, another side of the releasing member, away from the short rod, is provided with an extension portion, an elastic member is connected between the extension portion and the long rod so that the releasing member is biased by elastic force of the elastic member for enabling the pressing portion to press against the bearing portion, the trip mechanism further includes an abutment member disposed in the fixing hole, the abutment member includes an abutment rod extending toward the extension portion;

a torque adjustment mechanism, having a screw rod passing through the shaft hole and the screw hole, one end of the screw rod extending out of the shaft hole and being provided with a rotatable knob, the knob being configured to drive rotation of the screw rod to enable the position of the long rod to be adjustable; and a digital display unit, having a display module disposed at the main body, at least one strain sensor being electrically connected to the display module and arranged on a peripheral side of the long rod for sensing the amount of deformation of the long rod and transmitting sensing information to the display module so that the display module outputs a corresponding torque value in a digital display manner.

2. The electro-mechanical torque wrench as claimed in claim 1, wherein the long rod has an upper face facing the short rod and a lower face opposite the upper face, the digital display unit includes a plurality of strain sensors, a first plural of the strain sensors are disposed on the upper face, and a second plural of the strain sensors are disposed on the lower face.

3. The electro-mechanical torque wrench as claimed in claim 1, wherein a position sensor is electrically connected to the display module and close to the torque adjustment mechanism, the position sensor and the screw rod are connected through a driving mechanism, the position sensor is configured to sense the amount of variation of the screw rod and transmit sensing information to the display module so that the display module outputs a corresponding torque value.

4. The electro-mechanical torque wrench as claimed in claim 3, wherein the driving mechanism includes a first gear connected to the screw rod, a second gear connected to the position sensor, and a third gear pivotally disposed at the tubular body and engaged between the first gear and the second gear.

5. The electro-mechanical torque wrench as claimed in claim 4, wherein the tubular body is provided with a pivot hole, the third gear is provided with a rotating shaft, and the rotating shaft is inserted in the pivot hole so that the third gear is pivotally disposed at the tubular body.

6. The electro-mechanical torque wrench as claimed in claim 1, further comprising an anti-misoperation unit, the anti-misoperation unit including a limiting member disposed at the tubular body and an operating member disposed on the screw rod, wherein the operating member enables to axially slide only along a displacement direction of the screw rod between a locked position and an unlocked position, when in the locked position, the operating member is confined by the limiting member so that the screw rod cannot be rotated, when in the unlocked position, the operating member is disengaged from the limiting member so that the screw rod is rotatable to adjust preset torque.

7. The electro-mechanical torque wrench as claimed in claim 6, wherein an outer side of the knob is recessed to form an accommodating trough, a bottom of the accommodating trough is further recessed to form a blind hole extending into the screw rod, an outer periphery of the screw rod is formed with a slot communicating with the blind hole, the operating member is accommodated in the accommodating trough and has a shaft portion inserted in the blind hole, the shaft portion is formed with a through hole corresponding to the slot, the through hole is provided with a limiting pin, an end of the limit pin extends out of the through hole and is located in the slot, so that the operating member enables to axially slide only along the displacement direction of the screw rod.

8. The electro-mechanical torque wrench as claimed in claim 7, wherein the limiting member has a polygonal hole corresponding to the shaft hole, when the operation member is in the locked position, the limiting pin is engaged and constrained in the polygonal hole so that the screw rod cannot be rotated, when the operation member is in the unlocked position, the limiting pin is disengaged from the polygonal hole so that the screw rod is rotatable to adjust torque.

9. The electro-mechanical torque wrench as claimed in claim 7, wherein one end of the shaft portion, located in the accommodating trough, is enlarged to form a head, the anti-misoperation unit further includes a spring, the spring is sleeved onto the shaft portion, two ends of the spring abut against the head and an inner wall surface of the accommodation trough respectively, so that the operating member is biased by elastic force of the spring.

10. The electro-mechanical torque wrench as claimed in claim 6, wherein the tubular body is formed with a plurality of positioning holes, the limiting member has a plurality of locking holes corresponding to the positioning holes, the anti-misoperation unit further includes a fixing member, the fixing member is disposed on the outside of the tubular body and has a plurality of perforations corresponding to the positioning holes, the anti-misoperation unit further includes a plurality of locking members, and the locking members are inserted in the corresponding perforations, the positioning holes and the locking holes, respectively, so as to fix the limiting member to the tubular body.

* * * * *